US009528232B2

(12) United States Patent
Alberson et al.

(10) Patent No.: US 9,528,232 B2
(45) Date of Patent: Dec. 27, 2016

(54) METHODS FOR THE MANUFACTURE OF A MODULE FOR USE IN A CRASH BARRIER AND ASSEMBLY OF THE CRASH BARRIER

(71) Applicant: THE TEXAS A&M UNIVERSITY SYSTEM, College Station, TX (US)

(72) Inventors: Dean C. Alberson, Bryan, TX (US); D. Lance Bullard, Jr., College Station, TX (US); C. Eugene Buth, Wellborn, TX (US); Michael S. Brackin, Bryan, TX (US)

(73) Assignee: THE TEXAS A&M UNIVERSITY SYSTEM, College Station, TX (US)

( * ) Notice: Subject to any disclaimer, the term of this patent is extended or adjusted under 35 U.S.C. 154(b) by 0 days.

(21) Appl. No.: 15/193,785

(22) Filed: Jun. 27, 2016

(65) Prior Publication Data

US 2016/0305080 A1 Oct. 20, 2016

Related U.S. Application Data

(63) Continuation of application No. 14/814,589, filed on Jul. 31, 2015, now Pat. No. 9,404,231.
(Continued)

(51) Int. Cl.

| | |
|---|---|
| ***E01F 15/00*** | (2006.01) |
| ***E01F 15/08*** | (2006.01) |
| ***E01F 15/04*** | (2006.01) |

(52) U.S. Cl.
CPC ..... *E01F 15/083* (2013.01); *E01F 15/0484* (2013.01); *E01F 15/08* (2013.01);
(Continued)

(58) Field of Classification Search
CPC ..... E01F 15/0484; E01F 15/08; E01F 15/083; E01F 15/085; E01F 15/086; E01F 15/088
(Continued)

(56) References Cited

U.S. PATENT DOCUMENTS

| | | | |
|---|---|---|---|
| 3,574,379 | A | 4/1971 | Jordan |
| 3,675,746 | A | 7/1972 | Irvine |

(Continued)

FOREIGN PATENT DOCUMENTS

| | | |
|---|---|---|
| DE | 102006010468 | 9/2007 |
| EP | 1331145 | 7/2003 |

(Continued)

OTHER PUBLICATIONS

Hydrocal® B-11 Product Data Sheet, dated Nov. 2010, p. 2 of 2.
(Continued)

*Primary Examiner* — Raymond W Addie
(74) *Attorney, Agent, or Firm* — Brinks Gilson & Lione

(57) ABSTRACT

A method of manufacturing a module suitable for use in a crash barrier includes adhering first and second cellular foam blocks to opposite sides of a diaphragm and wrapping a wrap layer around a periphery of the first and second cellular foam blocks. In one embodiment, the wrap layer is configured as a metal cover member. Methods of assembling a crash barrier include one or more of positioning a plurality of modules end to end, supporting the modules with a base, covering a junction between adjacent modules with a connector, and/or coupling a mounting portion to the base.

22 Claims, 7 Drawing Sheets

Related U.S. Application Data

(60) Provisional application No. 62/042,034, filed on Aug. 26, 2014.

(52) U.S. Cl.
CPC ..... *E01F 15/085* (2013.01); *E01F 15/086* (2013.01); *E01F 15/088* (2013.01)

(58) Field of Classification Search
USPC ..... 404/6, 72
See application file for complete search history.

(56) References Cited

U.S. PATENT DOCUMENTS

| | | | | |
|---|---|---|---|---|
| 3,876,185 | A | 4/1975 | Welch | |
| 3,880,404 | A | 4/1975 | Fitch | |
| 3,967,704 | A | 7/1976 | Ogden | |
| 4,007,917 | A | 2/1977 | Brubaker | |
| 4,042,057 | A | 8/1977 | Beckley | |
| 4,321,989 | A | 3/1982 | Meinzer | |
| 4,658,941 | A | 4/1987 | Gottwald et al. | |
| 4,822,208 | A | 4/1989 | Ivey | |
| 4,909,661 | A | 3/1990 | Ivey | |
| 5,098,124 | A | 3/1992 | Breed et al. | |
| 5,156,485 | A | 10/1992 | Ivey et al. | |
| 5,192,157 | A | 3/1993 | Laturner | |
| 5,295,757 | A | 3/1994 | Ivey et al. | |
| 5,403,112 | A | 4/1995 | Carney, III | |
| 5,607,252 | A | 3/1997 | Tischer | |
| 5,746,537 | A | 5/1998 | Kellas et al. | |
| 5,779,389 | A | 7/1998 | Niemerski | |
| 5,814,250 | A | 9/1998 | Dudt et al. | |
| 5,823,584 | A | 10/1998 | Carney, III | |
| 5,885,025 | A | 3/1999 | Angley et al. | |
| 6,004,066 | A | 12/1999 | Niemerski | |
| 6,096,403 | A | 8/2000 | Wycech | |
| 6,179,516 | B1 * | 1/2001 | Ivey | E01F 15/146 256/13.1 |
| 6,213,540 | B1 | 4/2001 | Tusim et al. | |
| 6,276,667 | B1 | 8/2001 | Arthur | |
| 6,287,666 | B1 | 9/2001 | Wycech | |
| 6,340,268 | B1 | 1/2002 | Alberson et al. | |
| 6,461,076 | B1 * | 10/2002 | Stephens | E01F 15/146 256/13.1 |
| 6,523,872 | B2 * | 2/2003 | Breed | B60R 19/00 188/377 |
| 6,623,204 | B2 | 9/2003 | Buehler | |
| 6,635,327 | B2 | 10/2003 | Ohira et al. | |
| 6,645,586 | B2 | 11/2003 | Ohira et al. | |
| 6,685,387 | B2 * | 2/2004 | Allen | B64F 1/025 188/377 |
| 6,758,627 | B2 | 7/2004 | King | |
| 6,793,256 | B2 | 9/2004 | Carley et al. | |
| 6,793,274 | B2 | 9/2004 | Riley et al. | |
| 6,926,461 | B1 | 8/2005 | Faller et al. | |
| 6,971,817 | B2 | 12/2005 | Allen et al. | |
| 7,128,496 | B2 * | 10/2006 | Rogers | E01F 13/126 404/10 |
| 7,168,880 | B2 * | 1/2007 | Kennedy, Jr. | C08G 18/10 404/10 |
| 7,234,687 | B2 | 6/2007 | King | |
| 7,261,490 | B2 | 8/2007 | Allen et al. | |
| 7,300,223 | B1 | 11/2007 | Kennedy, Jr. et al. | |
| 7,311,965 | B2 | 12/2007 | Hojali et al. | |
| 7,351,002 | B2 | 4/2008 | Yodock, III et al. | |
| 7,371,029 | B2 | 5/2008 | Rogers et al. | |
| 7,399,028 | B1 | 7/2008 | Castillo et al. | |
| 7,410,320 | B2 | 8/2008 | Faller et al. | |
| 7,484,906 | B2 * | 2/2009 | La Turner | E01F 15/146 256/13.1 |
| 7,488,017 | B2 | 2/2009 | Lassi et al. | |
| 7,547,157 | B2 | 6/2009 | Yodock, III et al. | |
| 7,597,502 | B2 | 10/2009 | Allen et al. | |
| 7,614,683 | B2 | 11/2009 | Roccato et al. | |
| 7,618,212 | B2 | 11/2009 | Yodock, III et al. | |
| 7,625,036 | B2 | 12/2009 | Cormier et al. | |
| 7,628,444 | B2 | 12/2009 | Cormier et al. | |
| 7,758,277 | B2 | 7/2010 | Laturner et al. | |
| 7,780,224 | B2 | 8/2010 | Roush | |
| 7,815,392 | B2 * | 10/2010 | Kwasny | E01F 15/083 404/6 |
| 7,828,492 | B2 | 11/2010 | Rogers et al. | |
| 7,832,713 | B2 | 11/2010 | King | |
| 8,021,074 | B2 | 9/2011 | Valentini et al. | |
| 8,021,075 | B2 * | 9/2011 | Valentini | B64F 1/025 188/371 |
| 2002/0025221 | A1 * | 2/2002 | Johnson | E01F 15/086 404/6 |
| 2004/0096273 | A1 | 5/2004 | Yodock, III et al. | |
| 2005/0254892 | A1 | 11/2005 | Yodock, III et al. | |
| 2006/0013651 | A1 * | 1/2006 | Williams | E01F 15/0453 404/6 |
| 2011/0082023 | A1 | 4/2011 | Strauven | |
| 2011/0255916 | A1 * | 10/2011 | Thompson | E01F 15/146 404/6 |
| 2012/0121325 | A1 * | 5/2012 | Buehler | E01F 15/146 404/6 |

FOREIGN PATENT DOCUMENTS

| | | |
|---|---|---|
| EP | 2431526 | 3/2012 |
| GB | 2292404 | 2/1996 |
| GB | 2322342 | 8/1998 |
| GB | 2399584 | 9/2004 |
| JP | 2000/226821 | 8/2000 |
| WO | WO 95/02562 | 1/1995 |
| WO | WO 97/10950 | 3/1997 |
| WO | WO 2009/141456 A1 | 11/2009 |
| WO | WO 2011/012884 | 2/2011 |

OTHER PUBLICATIONS

Pittsburg Corning Foamglas®, "Formglas® Insulation Systems for Industrial Applications with operating temperatures of –450°F to +900°F (–268°C to +482°C)," dated Dec. 2004, 36 pages.

Pittsburgh Corning Foamglas®, "Industrial Piping, Ducts and Equipment," dated Nov. 2011, 2 pages.

Roof Systems Industrial Coatings RMI™, "Garna-Prime® Urethane Primer Adhesive Product Information," dated Sep. 22, 2002, 2 pages.

TRL Limited Vehical Safety Systems Group, Evaluation of Cellular-Glass-Customer: Pittsburg Corning Europe, TRL Reference: 11105710, dated Aug. 2001, 17 pages.

* cited by examiner 549
12
34
14
37
38
17
36
11
42
6
4
2
44
10
208
298
254
250
20
18
16

FIG. 14
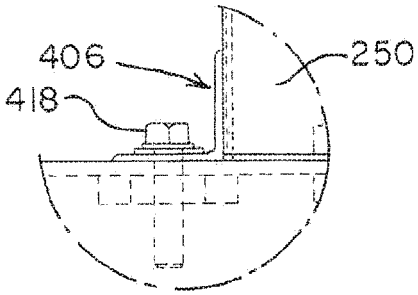
FIG. 16
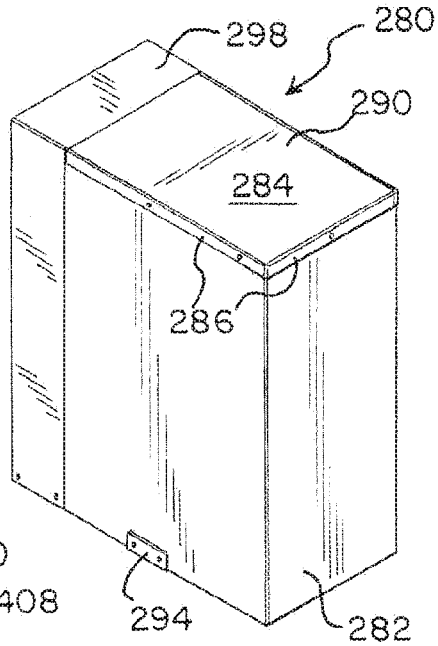
FIG. 15
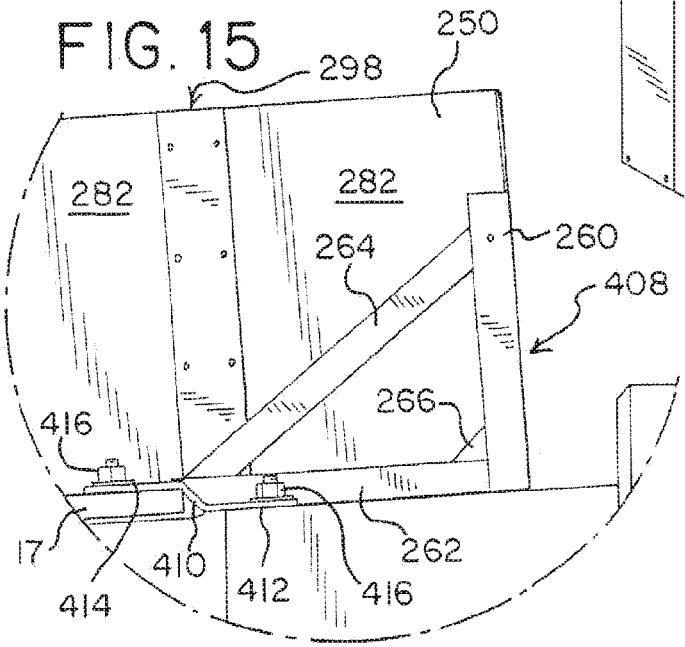
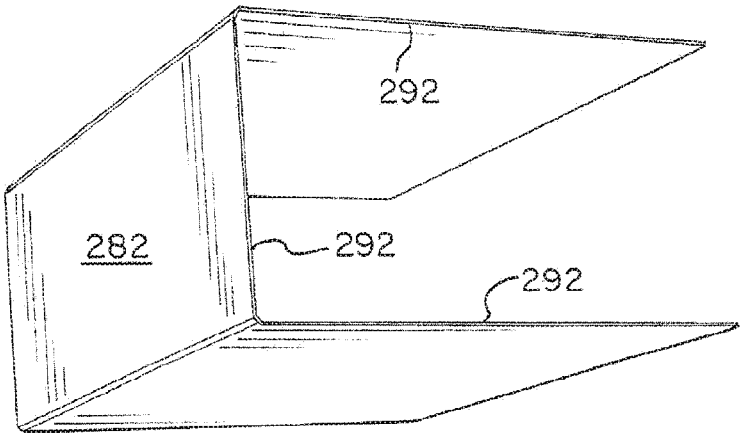
FIG. 17

MODULE NUMBERS
1 2 3 4 5 6 7 8 9 10 11 12 13 14 15 16 17 18 19
8
10
12
16
17
18
20
20
401
401
404
409
409
501

54
526
525
526
503
505
523
523
527
509
511
513
515
507
529
531
531
501
509
4
2
β
2
541
541
529
513
517
519
521
527
505
503

METHODS FOR THE MANUFACTURE OF A MODULE FOR USE IN A CRASH BARRIER AND ASSEMBLY OF THE CRASH BARRIER

This application is a continuation of U.S. application Ser. No. 14/814,589, filed Jul. 31, 2015, which claims the benefit of U.S. Provisional Application No. 62/042,034, filed Aug. 26, 2014, the entire disclosures of which are hereby incorporated herein by reference.

TECHNICAL FIELD

The present application relates generally to a crash barrier module incorporating a cellular foam material, and to a crash barrier, transition rail and various methods for the manufacture and use thereof.

BACKGROUND

Concrete barrier walls are commonly used to redirect errant vehicles back onto a roadway. The terminal ends of such barrier walls, together with other hazards, such as trees, signs, culverts and bridge piers, may present a peril to oncoming traffic if left exposed. Accordingly, various crash barriers have been developed and used along highways to protect errant motorists from these types of hazards. Typically, such crash barriers are positioned in front of, or at the end of, the barrier wall or other hazard.

In one system, lightweight cellular concrete crash barriers have been developed for use with concrete barrier walls. Such end treatments, however, may be susceptible to water degradation due to their "open-cell" nature. Other systems have incorporated fiberglass and/or foamed polyurethane cartridges, which may be relatively expensive to manufacture and/or susceptible to ultraviolet radiation and water absorption. Moreover, many crash cushion systems using energy absorbing cartridges incorporate relatively complex and expensive containment systems, including for example collapsible frames, often made of metal. As such, the need remains for a low cost, weather resistant crash barrier, which is easy to manufacture, install and maintain.

SUMMARY

Briefly stated, in one aspect, one embodiment of a module suitable for use in a crash barrier has a diaphragm with opposite first and second sides. First and second cellular foam blocks are coupled to the first and second sides of the diaphragm respectively. In one embodiment, the cellular foam blocks are made of cellular glass foam. A wrap layer surrounds a periphery of the first and second cellular foam blocks. In one embodiment, a sealant layer may be applied to the wrap layer. In another embodiment, a coating may be applied over the sealant layer.

In another aspect, one embodiment of a crash barrier includes a module made at least in part of a cellular foam material. The module may have a bottom supported on a surface of a base. In one embodiment, the modules includes a diaphragm having a mounting portion extending downwardly from a bottom surface of first and second cellular foam blocks. The mounting portion may include a guide member, which is received in a longitudinal track formed in the base.

In another embodiment, the crash barrier includes first and second cellular foam blocks defining front and rear ends and opposite sides of the module. The wrap layer is configured as a cover member covering a top, the front and rear ends and the opposite sides of the module. In one embodiment, the cover member may be made of metal, for example and without limitation Aluminum, or other suitable materials such as fiberglass or plastic.

In one embodiment, the crash barrier may include a plurality of modules positioned end-to-end in a longitudinal array.

In another aspect, a method of manufacturing a module for use in a crash barrier includes adhering first and second cellular foam blocks to opposite sides of a diaphragm and wrapping a wrap layer around a periphery of the first and second cellular foam blocks. In one embodiment, the method may include applying a sealant layer to the wrap layer. In other embodiments, a coating may be applied over the sealant layer. In other embodiments, the wrap layer is configured as a cover member. In one embodiment, the method also includes securing adjacent modules with a connector.

In another aspect, a transition rail for a crash barrier includes a first elongated portion having a first end and a second end, with the first portion extending in a longitudinal direction. A second elongated portion also includes a first end and a second end, with the first end of the second portion being connected to the second end of the first portion. The second portion forms an obtuse angle relative to the first portion when viewed from a first direction orthogonal to the longitudinal direction. The first end of the first portion includes a first connector operable to permit movement of the first and second portions in a lateral direction. The second end of the second portion includes a second connector operable to limit lateral movement of the second end.

In yet another aspect, a crash barrier system includes a first crash barrier having spaced apart ends and a first cross-sectional profile, and a second crash barrier having spaced apart ends and a second cross-sectional profile. The second cross-sectional profile is different than the first cross-sectional profile. A transition rail has a first end connected to the first crash barrier with a first fastener extending in a first direction, and a second end connected to the second crash barrier with a second fastener extending in a second direction transverse to the first direction.

In another aspect, a method of assembling a crash barrier system includes orienting a first crash barrier along a longitudinal direction, positioning a second crash barrier adjacent to the first crash barrier and orienting the second crash barrier along the longitudinal direction. The first and second crash barriers have different cross-sectional profiles. The method further includes securing a first end of a transition rail to the first crash barrier with a connector, moving the transition rail about the connector until a second end of the transition rail abuts the second crash barrier, and securing the second end of the transition rail to the second crash barrier.

The various aspects and embodiments provide significant advantages over other modules, crash barriers and methods of manufacture and use. For example and without limitation, the cellular foam blocks are closed cell, meaning they are less susceptible to water penetration and degradation. Moreover, the modules are lightweight and portable, and relatively inexpensive to manufacture. The modules may be easily constructed with a mounting portion, making them adaptable to various support systems. The wrap and sealant layers, e.g. cover member, maximize the containment of the cellular foam material and ensure maximum performance.

The transition rail also provides significant advantages. The rail increases the height of the barrier, e.g. the base, so as to prevent a vehicle from riding up onto the adjacent barrier. Conversely, the rail eliminates a snag point that may otherwise occur during a reverse direction impact where one of the barriers has a different profile than the other. In addition, the rails are symmetrical, meaning they can be secured on either side of the barriers and system. The configuration of the rails, and the connectors, also allows for lateral movement to accommodate varying width barriers.

The present embodiments, together with further advantages, will be best understood by reference to the following detailed description taken in conjunction with the accompanying drawings. Nothing in this section should be taken as defining or limiting the scope of the claims, or any term used therein, which claims are solely intended to define the invention.

BRIEF DESCRIPTION OF THE DRAWINGS

FIG. 16 is a top, perspective view of an alternative embodiment of a module with a connector.

FIG. 17 is a perspective view of a side cover.

DETAILED DESCRIPTION OF THE PRESENTLY PREFERRED EMBODIMENTS

Figures 1, 2, 3, 4, 5, 8:
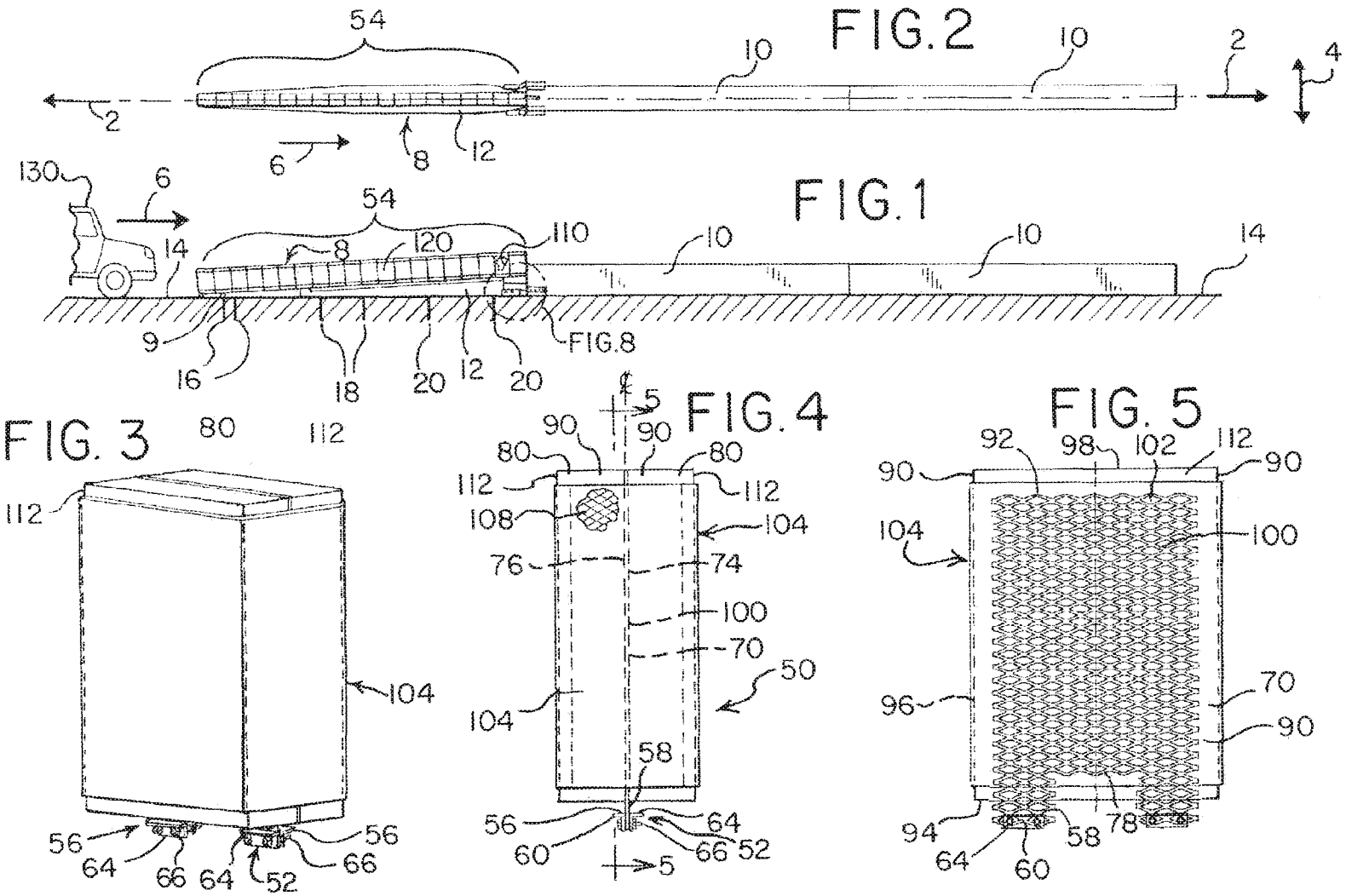
FIG. 1 is a side view of one embodiment of a crash barrier positioned in front of a concrete barrier wall.
FIG. 2 is a top view of the crash barrier shown in FIG. 1.
FIG. 3 is perspective view of a module suitable for use in a crash barrier without a sealant layer or coating applied thereto.
FIG. 4 is an end view of the module shown in FIG. 3.
FIG. 5 is a cross-sectional side view of the module taken along line 5-5 of FIG. 4.
FIG. 8 is an enlarged view of the connection between a base and a barrier wall taken along line 8 of FIG. 1.

Referring to FIGS. 1 and 2, it should be understood that the term "longitudinal," as used herein means of or relating to length or the lengthwise direction 2 of a crash barrier, which is parallel to and defines an "axial impact direction." The term "lateral," as used herein, means directed toward or running in a lateral direction 4 perpendicular to the side of the crash barrier. The term "transverse" means across, or non-parallel, and may include two features lying orthogonal to each other. The term "coupled" means connected to or engaged with, whether directly or indirectly, for example with an intervening member, and does not require the engagement to be fixed or permanent, although it may be fixed or permanent, and includes both mechanical and electrical connection. It should be understood that the use of numerical terms "first," "second" and "third" as used herein does not refer to any particular sequence or order of components; for example "first" and "second" blocks may refer to any sequence of such blocks, and is not limited to the order of blocks in an upstream or downstream direction unless otherwise specified. The term "yield" means to bend or deform, without breaking. The term "downstream," as used herein refers to the direction 6 with the flow of traffic that is approaching a front of the crash barrier and/or barrier wall, whereas the term "upstream" means in a direction against or opposite the downstream direction 6, or the flow of traffic, when bi-directional, approaching a rear of the crash barrier. The term "plurality" means two or more, or more than one.

Figures 21, 22, 23, 26, 27:
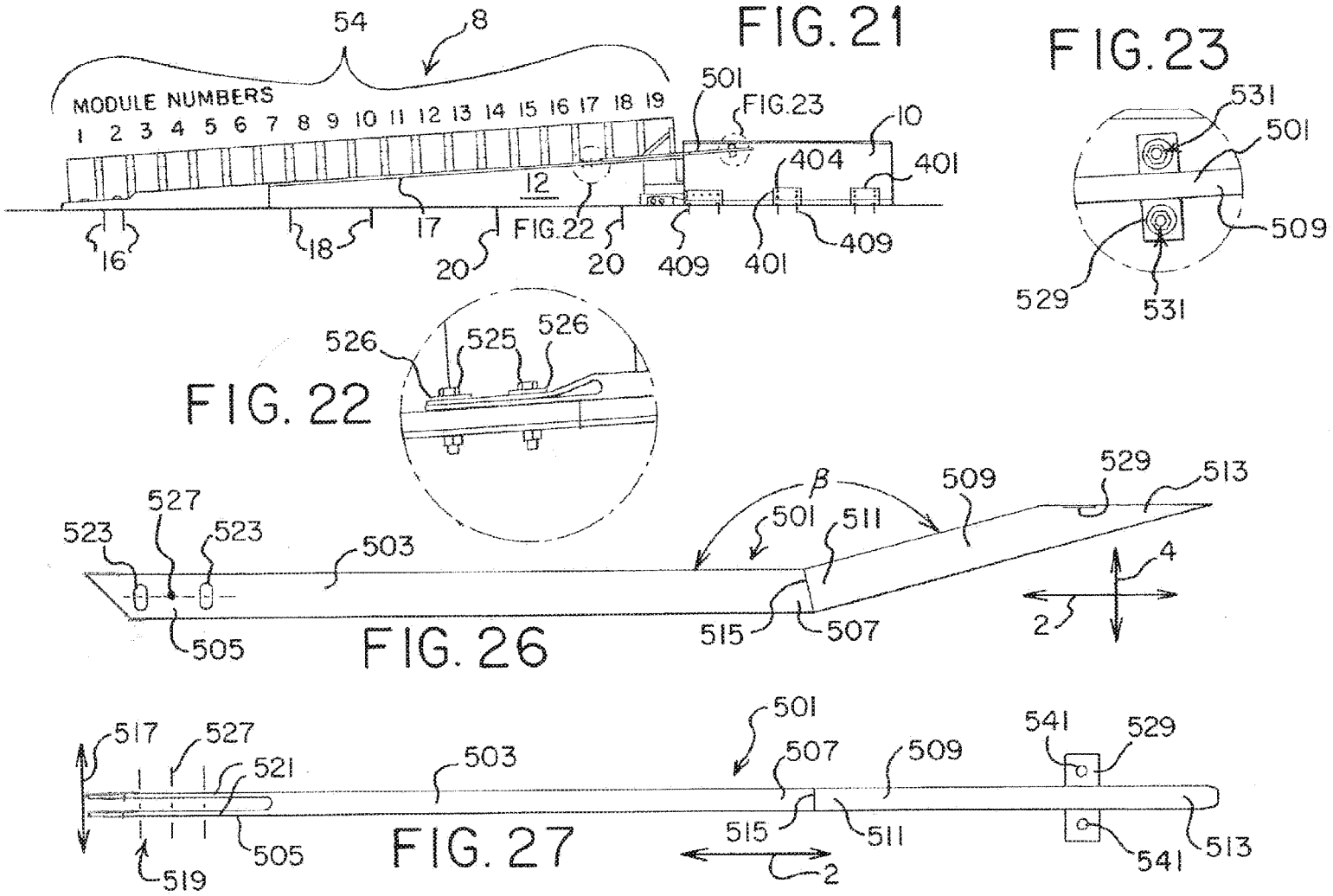
FIG. 21 is a side, elevation view of another embodiment of a crash barrier configured with a transition rail.
FIG. 22 is an enlarged, partial view of the transition rail taken along line 22 of FIG. 21.
FIG. 23 is an enlarged, partial view of the transition rail taken along line 23 of FIG. 21.
FIG. 26 is a top view of one embodiment of a transition rail.
FIG. 27 is a side view of the transition rail shown in FIG. 26.
Figure 24:
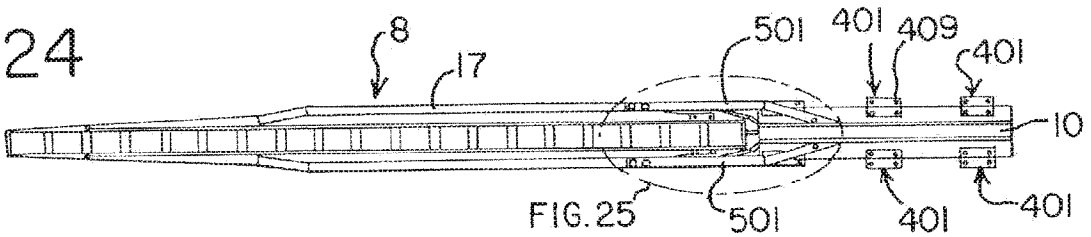
FIG. 24 is a top view of the crash cushion shown in FIG. 21.
Figure 25:
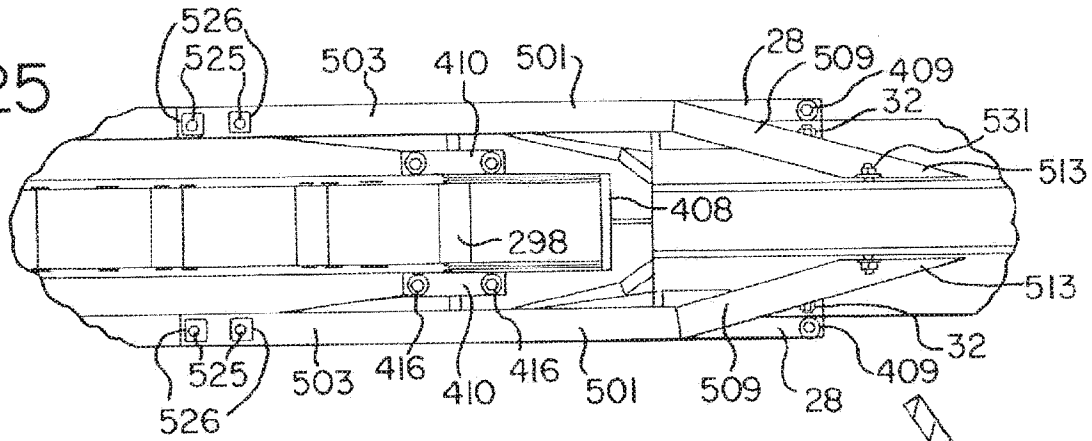
FIG. 25 is an enlarged partial view of the crash cushion and transition rail taken along line 25 of FIG. 24.
Figure 28:
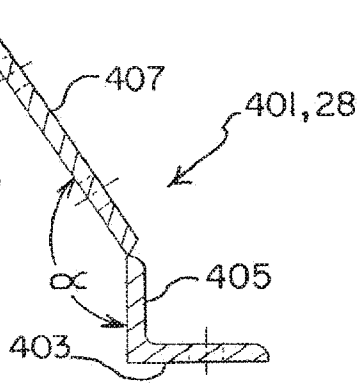
FIG. 28 is a cross-sectional view of one embodiment of an anchor bracket.

FIGS. 1, 7, 13, 21 and 29 show embodiments of a crash barrier 8 positioned in front of a hazard, shown as a concrete barrier wall formed from a plurality of concrete barriers 10. The concrete barriers 10 may be secured to the ground using a plurality of anchor brackets 401. Referring to FIGS. 21, 24 and 28, the brackets 401 include a base flange 403, an upright vertical flange 405, and an angled flange 407 welded to and forming an obtuse angle $\alpha$ relative to the vertical flange 405. In one embodiment, a is about 145°. The vertical and angled flanges are arranged so as to nest against a matching outer profile of the barrier 10. Threaded anchor bolts 409, for example and without limitation ¾ inch×6½ inch anchors, are then secured to the ground, e.g., pavement, and to the barrier, with epoxy.

Figure 7:
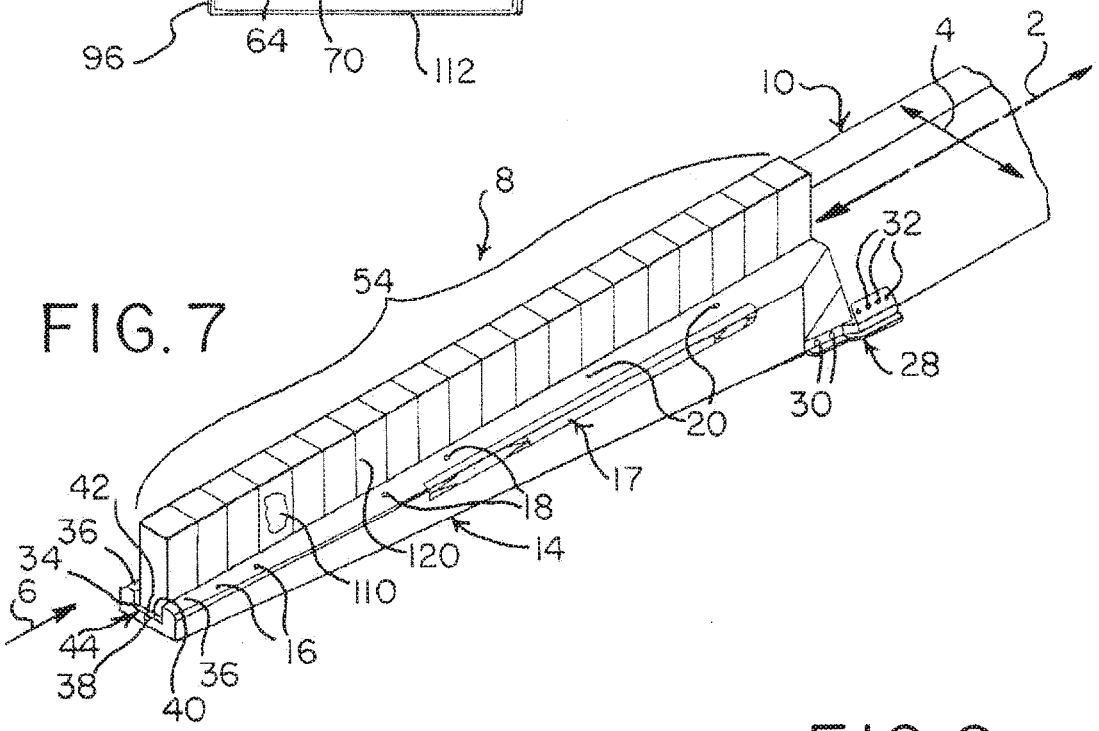
FIG. 7 is a perspective view of the crash barrier shown in FIG. 1.
Figure 8:
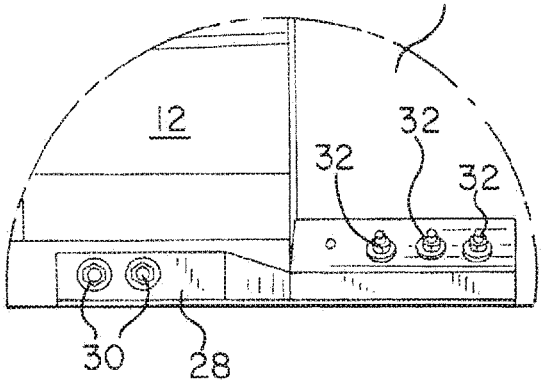
Figure 9:
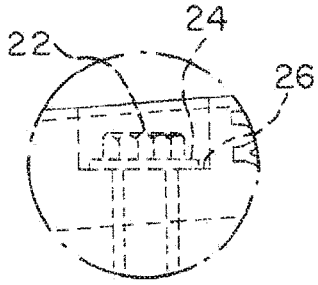
FIG. 9 is an enlarged view of an anchor pin positioned in a base taken along line 9 of FIG. 1.
Figures 10, 11, 12, 13, 14, 15:
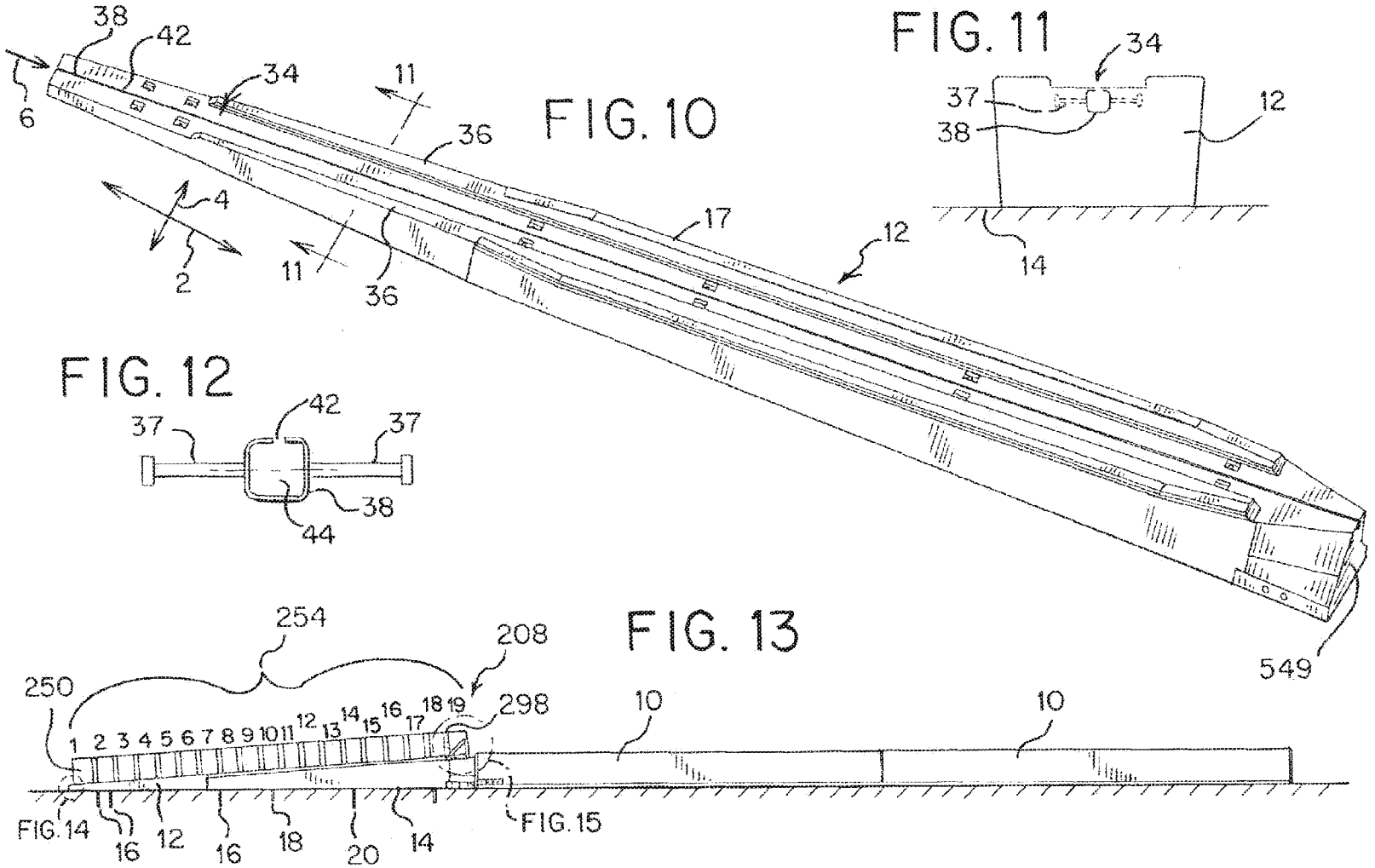
FIG. 10 is a perspective view of a base.
FIG. 11. is a cross-sectional view of the base taken along line 11-11 of FIG. 10.
FIG. 12 is an enlarged view of a track.
FIG. 13 is a side, elevation view of one embodiment of a crash barrier.
FIG. 14 is an enlarged view of a front stop take along line 14 of FIG. 13.
FIG. 15 is a side view of a backstop assembly taken along line 15 of FIG. 13.
Figure 19:
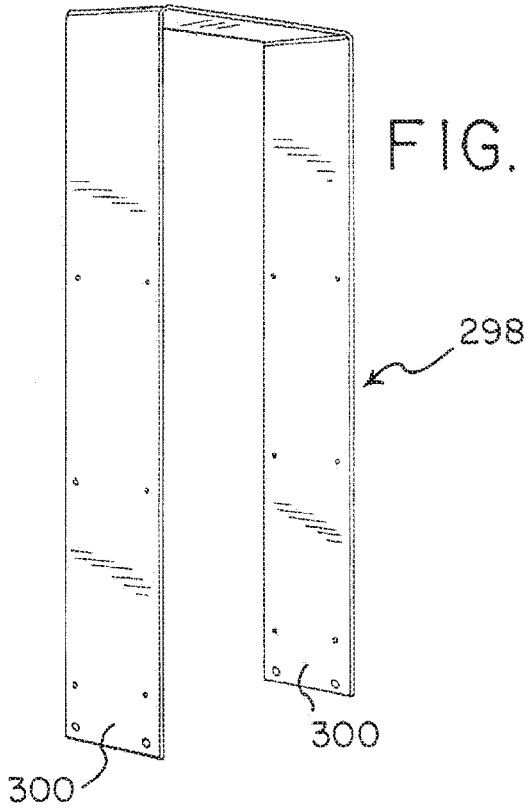
FIG. 19 is a perspective view of a connector.
Figure 18:
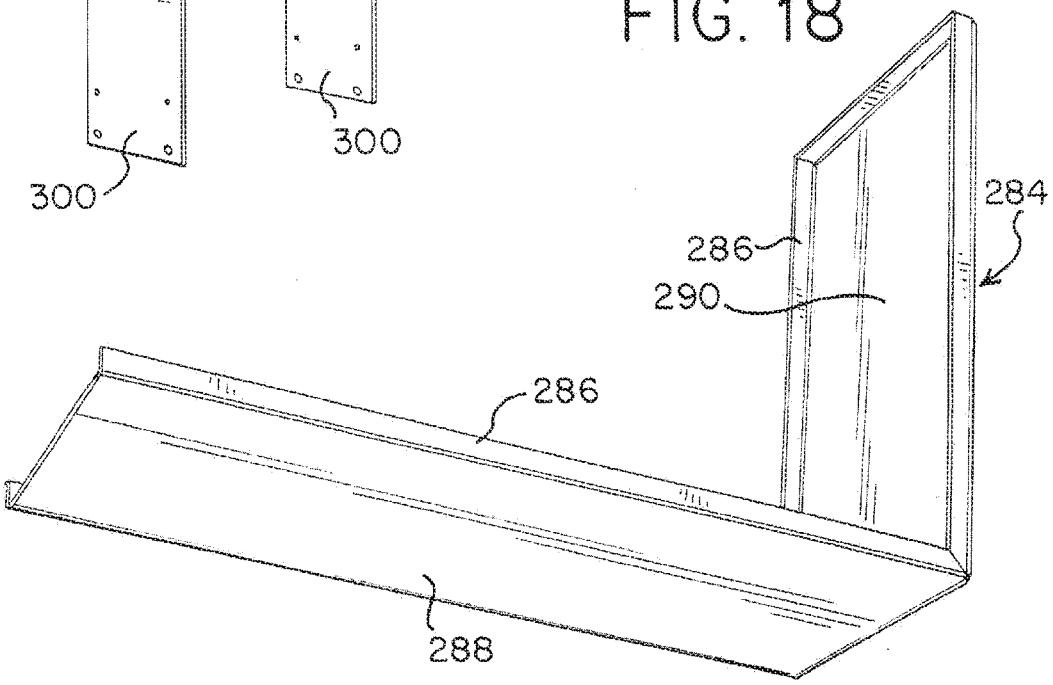
FIG. 18 is a perspective view of a top cover.
Figure 20:
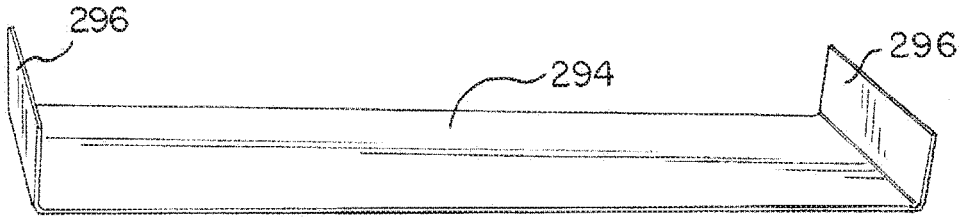
FIG. 20 is a perspective view of a bottom bracket.

Referring to FIGS. 1, 7 and 10, the crash barrier 8 includes a base 12 anchored to the ground 14, and to the upstream end of the concrete barrier wall or adjacent concrete barrier 10. One suitable base is an ADIEM® base available from Trinity Highway Products, Dallas, Tex. In one embodiment, the base 12 is secured to the ground with a plurality of pins 16, 18, 20, which may have various exemplary lengths of 30 inches, 36 inches and 48 inches, or other lengths deemed appropriate. As shown in FIGS. 1 and 9, the pins include a head 22 supported by a washer 24 engaging the base, for example in socket having a shoulder 26. The pins extend vertically through the base 12 and penetrate the ground 14. For example, in one embodiment, a plurality of front anchor pins 16 (shown as two pairs of two pins spaced apart on opposite sides of longitudinal axis 2) may be 1 inch diameter, and from 18 to 30 inches in length depending on the type of ground material, which may be concrete or soil. In one embodiment, a plurality of middle pins 18 (shown as 4) may be 1 inch diameter and between 24 and 36 inches in length, while a plurality of back pins 20 (shown as 4) may be 1 inch diameter and between 36 and 49 inches in length. It should be understood that other numbers of pins of other dimensions and lengths may also be suitable.

As shown in FIGS. 1, 7, 8, and 28 brackets 28 are secured to opposite sides of the base at the rear end thereof with a plurality of fasteners 30. The brackets 28 each include a flange 407 secured to outwardly extending flanges of the upstream barrier wall 10 with a plurality of fasteners 32, and to the ground with an anchor 409. In one embodiment, the base 12 is 30 feet long, and has a support surface inclined at an angle of more than 2 degrees, and in one embodiment more than 3 degrees, and may be inclined at an angle of 3.18 degrees. It should be understood that different lengths and angles of pitch may be suitable for various uses. In one embodiment, the base 12 is made of concrete. It should be understood that the term "base" may simply refer to a ground surface, including a simple concrete pad, asphalt or soil.

As shown in FIGS. 7 and 10-12, the base 12 has a central channel 34 formed by laterally spaced walls 36, and a longitudinal track 38 formed along a bottom of the channel 34, with the channel running the length of the base 12. A bottom surface 40 of the channel defines a support surface. The track 38, centrally located in the channel 34, includes a slot 42 and a cavity 44 spaced below the support surface. The track 38, with the slot and cavity, may be formed by a roll-formed metal rail, or by a pair of spaced apart rails (e.g., C-shaped or I-shaped), with the rails being embedded in the base and having embedded anchor members 37 extending laterally outwardly from the rail. The base 12 may also include side tube rails 17 cast into the base. One exemplary base is shown in U.S. Pat. No. 4,909,661, which is hereby incorporated herein by reference, and further includes the base incorporated in the ADIEM® crash barrier system made and sold by Trinity Highway Products, Dallas, Tex.

Referring to FIGS. 21-27, barrier 8 may be further secured to the barrier 10 with one or more transition rails 501, attached along one or both sides of the barriers 8, 10. In particular, the transition rail 501 has a first portion 503 extending in a longitudinal direction 2 and having first and second ends 505, 507, and a second portion 509 extending in longitudinal and lateral directions 2, 4 and having first and second ends 511, 513. The second end 507 of the first portion 503 is connected to the first end 511 of the second portion 509, for example with a weld 515. The first and second portions may be made of steel tube, for example HSS 4×2×¼ A500 Grade B/C material. The second portion 509 forms an obtuse angle β relative to the first portion 503 when viewed from a first direction 517 orthogonal to the longitudinal and lateral directions, as shown in FIGS. 26 and 27. In one embodiment, the angle β may be about 165°. The first end 505 of the first portion is formed as a clevis 519, with a pair of flanges or plates 521 spaced apart in the first direction 517. The first end 505 may have a taper, or be sloped, and comes to a point as shown in FIG. 26, so as to eliminate or reduce the potential for snagging. Each plate has a pair of slotted openings 523 elongated in the lateral direction 4, with the openings in the plates being aligned in the first direction 517. The slotted openings 523 and fasteners 525, e.g., bolts (see FIG. 22), secured with a washer 526, define an adjustable first connector, which permits lateral movement of the rail 502 in the lateral direction 4, as well as rotational movement about an axis 527 extending in the first direction 517. Rotational movement is achieved when the fasteners 525 are moved in opposite directions within the slotted openings 523. In this way, the second portion 509 may be moved toward or away from a side of a barrier 10. The second portion 509 includes a plate 529, extending in the first direction 517 above and below the rail in one embodiment. The plate 529, and fasteners 531 (see FIG. 23) define a second connector, with the fasteners 531 extending in the lateral direction orthogonal to the first direction 517. The plate 529 has a pair of openings 541 oriented in the lateral direction 4 transverse to the first direction 517, and orthogonal thereto in one embodiment. The second connector, and in particular the plate 529 thereof, functions as a stop, and is operable to limit the lateral movement and/or rotation of the rail 501 relative to the barriers 8, 10. As shown in FIGS. 24-27, the rails 501 are symmetrical, and may be attached to opposite sides of the barriers 8, 10.

Figure 29:
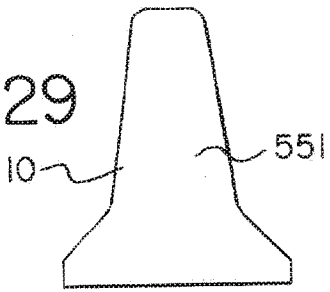
FIG. 29 is a cross-sectional profile of one embodiment of a crash barrier.

During assembly, a first end 505 of the rail is secured to the barrier 8, for example by securing fasteners 525 through the clevis 519 and into the base 12, for example the base side rails 17. The second end 513 of the second portion is then abutted against the side of the barrier 10. The second end 513 is tapered and comes to a point so as to provide a smooth transition between the side of the barrier 10 and the rail 501. The elongated slots 523 permit the rail 501 to be translated and rotated in a lateral direction so as to accommodate different width barriers 10. Once the rail 501 is properly positioned, the anchor bolts 525 may be tightened so as to flatten the clevis 519 and draw the plates 519 together as shown In FIG. 22. The fasteners 531 may also be installed so as to secure the second end of the rail 501 to the barrier 10. The clevis 519 contributes to the symmetry of the rail, permitting either plate to be drawn downwardly, depending on which side the rail is position. The angle α of the second portion 509 relative to the first portion 503 provides a smooth transition between the barriers 8, 10 so as to eliminate any snag points that may occur in reverse direction impacts where the adjacent, cross-sectional profiles 549, 551 of the barriers 8, 10 do not match. For example, the barrier 8, and in particular the base 12 has a first cross-sectional profile 549, taken along an end of the barrier 8 perpendicular to the longitudinal axis 2 as shown in FIG. 10, while the barrier 10 has a second cross-sectional profile 551 taken along an adjacent end of the barrier 10 as shown in FIG. 29. The profiles 549, 551 may be the same or different. The rails 501 also prevent a vehicle 130 from riding up on the barrier 10 during an impact event.

Referring to FIGS. 1, 2, 7 and 13, a plurality (shown in different embodiments as 20 or 19) of modules 50, 250 are disposed in the channel 34 and positioned in an array 54, 254 and abutted end-to-end along the bottom support surface 40 of the base. Each module 50, 250 includes at least one mounting portion 52, configured in one embodiment as a T-shaped or I-shaped guide member 56. As shown in FIGS. 3-6, the module 50, 250 is configured with a pair of guide members 56, each having a leg portion 58 and a foot portion 60. In one embodiment, the foot portions 60, or feet, are defined by a pair or of L-shaped brackets 64 secured back-to-back on opposite sides of a diaphragm leg portion 58 extending downwardly from a bottom surface 62 of the module. The brackets 64 may be secured with a pair of fasteners 66 (bolts and nuts), welding, forming, or other known solutions or combinations thereof. Alternatively, the guide members, and feet portions in particular, may be integrally formed, for example by extrusion, or may assume other shapes suitable for engaging and being entrapped within, on or below a track. The brackets 64 have opposing flanges extending laterally outwardly from the diaphragm leg portion 58. The leg portion 58 extends through the slot 42, with the feet portions 60 disposed in the cavity 44 of the track. The feet portions 60 are trapped in the cavity, and engage the top of the cavity to retain the module 50 in the track 38. The modules 50 are initially coupled to the base by sliding the guide members 56 of the modules along the track, from a front or back of the base, to a desired position, with the bottom of the module resting on the support surface 40. The next module in the array is then similarly coupled to the base and moved into position adjacent the previously installed module. Alternatively, the modules 250 may be additionally coupled one to other with a connector strap as further explained below.

In one embodiment, and referring to FIGS. 13-15, a front stop bracket 406 is abutted against a forwardmost module 50, 250 to maintain the position of the array and secured to the base with a fastener 418, while a backstop assembly 408 is abutted against the rearwardmost module 50, 250 in the array. The backstop assembly 408 includes an upright backstop member 260 having a front surface engaging the modules, and a pair of forwardly extending supports 262 secured to the base 12, for example with a flange 410 having a lower portion 412 and a stepped up upper portion 414 secured to the base with fasteners 416. A plurality of support straps 264, 266 secure the backstop 260 to the supports.

Referring to FIGS. 3-5, a diaphragm 70 extends vertically along a centerline 72 of the module 50, 250, and includes in one embodiment a pair of leg portions 58 defining in part the guide members. It should be understood that the module, and diaphragm, may be configured with only one guide member, or more than two guide members. In other embodiments, the modules may be configured without any guide members, and may simply rest on a support surface, defined by a base or the ground. Or, the modules may be configured with mounting portions that are configured in other ways to engage and be coupled to the base, including various guide systems, or various release systems such as break-away fasteners. The modules also may or may not be restrained in a vertical and/or lateral direction by various retention devices such as tethers, anchors, guides, etc.

In one embodiment, the diaphragm 70 is made of an expanded metal panel. In an exemplary embodiment, the panel is made of ¾ #9 gauge carbon steel flattened, galvanized panel. Other materials, e.g., metal, plastic, fiberglass, wood, may also be suitable. The panel includes a plurality of apertures 102, shown as diamond shaped openings, in the expanded metal embodiment of FIG. 5. Other shapes and sizes of apertures may be suitable. In other embodiments, the panel may be configured without any apertures.

As shown in FIGS. 3-6, first and second cellular foam blocks 80 are coupled to first and second sides 74, 76 of the diaphragm. In one embodiment, the cellular foam blocks 80 are made of glass foam, for example a FOAMGLAS® HLB800 cellular glass foam material, and are configured as 18×24×5 (18 inches long by 24 inches tall by 5 inches wide) rectangular solid blocks. It should be understood that other shapes and dimensions may be suitable. The glass foam material has a closed cell structure, with the individual cells collapsing upon impact wherein energy is consumed. The glass foam material is inert, made of glass and silicon, non-combustible and is not susceptible to moisture intrusion. The glass foam material also is not susceptible to UV degradation. The glass foam blocks may be easily molded in any desired shape, and are easily cut or shaped after formation. The glass foam material provides an outer surface suitable and receptive to various adhesives. In one embodiment, the glass foam blocks 80 are wider and taller than the diaphragm panel 70, such that the diaphragm bottom, top and side edges 78, 90, 92 are spaced inwardly from the outer bottom, top, and side 94, 96, 98 surfaces of the blocks (e.g., 1-3 inches), with the exception of the leg portions 58, which extend downwardly from the bottom surface 94. Other cellular foam structures may also be suitable for the blocks 80, including without limitation cellular foams made of polyurethane and/or polyisocyanurate.

The first and second cellular foam blocks 80 are coupled to the first and second sides 74, 76 of the diaphragm with an adhesive 100. When the diaphragm includes apertures, the adhesive 100 permeates the diaphragm through the apertures 102, bonding the first and second blocks 80 to each other, as well as to the first and second sides 74, 76 of the diaphragm 70. The adhesive 100 may be applied to the inner surfaces of the first and second cellular foam blocks, to the first and second sides of the diaphragm, or both. In one embodiment, the adhesive 100 is formed by a gypsum cement product, e.g., drywall mud. One suitable adhesive is a Hydrocal® B-11 gypsum cement, which is mixed with water to form an inorganic, noncombustible adhesive. The Hydrocal® adhesive is particularly well suited for bonding FoamGlas® cellular glass foam blocks. It should be understood that the cellular foam blocks may also be coupled to the diaphragm, or first and second sides thereof, and/or to each other with the diaphragm disposed therebetween, with mechanical fasteners, such as screws, bolts, rivets, rods, etc., alone or in combination with various adhesives. It should be understood that cellular foam blocks are "coupled" to the first and second sides of the diaphragm even when the mechanical fastener connect the foam blocks to each other with the diaphragm sandwiched therebetween.

Figure 6:
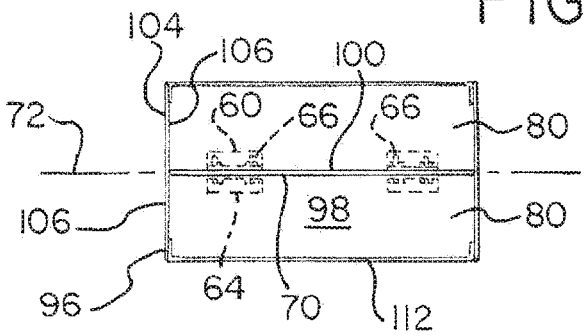
FIG. 6 is a top view of the module shown in FIG. 3.

Referring to one embodiment of the modules 50, after the cellular foam blocks 80 are adhered or connected to the diaphragm 70, or while the adhesive 100 is curing, a wrap layer 104 is wrapped around the periphery of the outer exposed surfaces (opposite ends and outermost side surfaces) of the first and second cellular foam blocks 80. In one embodiment, the wrap layer is formed as a thin, resilient sheet of material, such as a 4.5 oz fiberglass mesh. The wrap layer 104 may be permeable, e.g., include a plurality of apertures 108 (shown as exaggerated in partial view of FIG. 4 for purposes of illustration). In other embodiments, the wrap layer may be devoid of apertures, and may be formed of metal, plastic sheeting, or other similar materials. In one embodiment, the wrap layer 104 is 22 inches tall, and surrounds the outer periphery of the first and second cellular foam blocks, with the ends 106 of the wrap layer overlapping as shown in FIG. 6. In one embodiment, the cellular foam blocks have a greater height than the wrap layer, such that portions of the cellular foam blocks are exposed below and above the wrap layer 104. In one embodiment, the ends 106 of the wrap layer overlap about 8 inches, with the opposite edges of the wrap layer being disposed inwardly from the opposite sides of the module about 1 inch on the each end of the module.

As shown in the partial cut-away of FIGS. 1 and 7, a sealant layer 110 is applied over the wrap layer, and penetrates the apertures 108 of the wrap layer 104 in one embodiment, bonding the wrap layer to the outer surfaces 90, 112 of the first and second cellular foam blocks and sealing the outer surface of the first and second cellular foam blocks. The sealant 110 may be applied over the entire surface of the module, including the exposed portions of the surfaces 90, 112, and the top and bottom surfaces 98, 94, of the first and second cellular foam blocks 80. In one embodiment, the sealant layer 110 is formed by a quick-set joint compound, or drywall mud. One exemplary and suitable embodiment is the Hyrdocal® B-11 gypsum cement also described above as a suitable adhesive. The sealant layer 110 seals any gaps between the blocks and/or pin holes in the blocks, so as to prevent water penetration.

A coating 120 is then applied over the sealant layer 110. The coating may include a plurality of separately applied coats of material. For example, the coating may include one coat of urethane primer, followed by two coats of a base. In an exemplary embodiment, the coating includes one coat of Garna-Thane® primer, or Garna-Prime® urethane primer adhesive, and two coats of Garna-Thane® base. Of course, it should be understood that the coating may include a single coating, or more than three coatings, whether of a primer or base. The coatings may be applied by spraying, or with a brush or roller applicator.

The coating 120 provides an additional weather barrier for the module 50. The wrap, sealant and coating layers 104, 110, 120 ensure that cellular foam blocks 80 hold together for as long as possible during an impact event, and further provide protection against invasive weather elements.

Referring to FIGS. 13 and 15-20, in an alternative embodiment of the modules 250, the wrap layer is configured as a cover member 280 positioned around the front and rear ends and opposite sides of combined first and second cellular foam blocks 80, which are coupled to the diaphragm 70, for example with adhesive and/or mechanical fasteners. The cover member also covers the top of the cellular foam blocks 80. In this embodiment, the cellular foam blocks 80 may or may not be provided with a wrap layer, sealant layer or coating. The cover member 280 includes a three sided side cover 282 that wraps around one end (front or rear) and two sides of the blocks 80. A top cover 284, including an inwardly extending flange 286 formed around the periphery thereof, has a side member 288 extending along an opposite end (rear or front) of the blocks and a top member 290 covering the top of the blocks. The flanges 286 overlap and lie outside peripheral edges 292 of the side cover 282 such that fluids are prevented from penetrating the cover. A U-shaped bottom bracket 294 extends underneath the modules and has a pair of upwardly extending flanges 296 secured to the outer surface of the side covers. Another U-shaped connector 298 is positioned over the junction of adjacent modules and covers the joint therebetween, with opposite bottom end portions 300 being secured to adjacent modules as shown in FIG. 16. The cover member 280, including the side cover 282, top cover 284, bottom bracket 294 and connector 298 may be made of a metal, such as Aluminum, including a 22 gauge or 0.032 AL Sheet. In other embodiments, the cover member may be made of other metals, including galvanized sheet metal, or various composite materials, such as fiberglass, or plastic. The cover members may be secured to the blocks and each other with rivets or sheet metal screws, alone or in combination with an adhesive.

During an impact event, and referring to FIG. 1, a vehicle 130 impacts the array 54, 254 of modules 50, 250, arranged end-to-end along the base 12, in the downstream direction 6. The modules 50, 250 sequentially crush and absorb energy. It should be understood that the modules 50, 250 in the array 54, 254 may provide different energy absorbing capabilities, for example by varying the density of the cellular foam blocks, such that the energy absorbing capabilities increase as the impacting vehicle 130 travels in a downstream direction 6 along the array 54. For example, in an nineteen (19) module array, the first nine (9) modules may be made of FoamGlas® cellular glass HLB 800 having a density of 7.5 lb/ft$^3$, while the back ten (10) modules may be made of a more dense FoamGlas® cellular glass HLB 1600, having a density of 10.0 lb/ft$^3$. Another suitable material may be a FoamGlas® cellular HLB 1200 having a density of 8.7 lb/ft$^3$. It should be understood that other cellular foams, including other cellular glass foams and cellular polyurethane and/or polyisocyanurate foam materials may also be suitable. In other embodiments, the modules 50 all have the same energy absorbing characteristics, and may be positioned at any location within the array 54, which simplifies the installation of the crash barrier.

The installation involves setting the base 12, for example by anchoring the base to the ground 14 and/or to the hazard, such as a concrete barrier wall 10. The modules 50, 250 are then disposed in the channel 34 and individually engaged with the track 38, and slid or moved along the channel 34 to a desired location. After an impact even, damaged or crushed modules 50, 250 may be removed and replaced. The modules 250 may further be connected one to the other with the connectors.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A method of manufacturing a module for use in a crash barrier, the method comprising:

coupling first and second cellular foam blocks to opposite sides of a diaphragm; and applying a wrap layer around a periphery of said first and second cellular foam blocks.

2. The method of claim 1 further comprising applying a sealant layer to said wrap layer.

3. The method of claim 2 wherein said sealant layer comprises a joint compound.

4. The method of claim 2 further comprising applying a coating over said sealant layer.

5. The method of claim 4 wherein said coating comprises a urethane primer.

6. The method of claim 1 wherein said diaphragm comprises a mounting portion extending downwardly from a bottom surface of said first and second cellular foam blocks.

7. The method of claim 1 wherein said wrap layer comprises a permeable material.

8. The method of claim 7 wherein said wrap layer comprises a plurality of apertures, and wherein said applying said sealant layer comprises permeating said plurality of apertures with said sealant layer and adhering said sealant layer to said first and second glass cellular blocks.

9. The method of claim 8 wherein said wrap layer comprises a fiberglass mesh.

10. The method of claim 1 wherein said diaphragm comprises a plurality of apertures, and wherein said coupling said first and second cellular foam blocks to opposite sides of a diaphragm further comprises permeating said plurality of apertures with an adhesive and adhering said first and second cellular foam blocks to said opposite sides of said diaphragm.

11. The method of claim 10 wherein said diaphragm comprises an expanded metal sheet.

12. The method of claim 11 wherein said adhesive comprises a gypsum cement product.

13. The method of claim 1 wherein said first and second cellular foam blocks define front and rear ends and opposite sides of said module, and wherein said wrap layer covers a top, said front and rear ends and said opposite sides of said module.

14. The method of claim 13 wherein said wrap layer comprises a cover member made of metal.

15. The method of claim 14 wherein said cover member is made of aluminum.

16. The method of claim 14 wherein said cover member comprises a side cover and a top cover separate from said side cover, and covering one of said front and rear ends and said opposite sides of said module with said side cover, and covering said top and the other of said front and rear ends with said top cover.

17. The method of claim 16 wherein said top cover comprises a flange extending from a periphery thereof and overlapping portions of said side cover with said flange.

18. The method of claim 16 further comprising positioning a bottom bracket comprising a pair of flanges underneath said module and connecting said pair of flanges to said opposite sides of said module.

19. A method of assembling a crash barrier comprising positioning a plurality of modules made in accordance with claim 1 end to end, supporting said plurality of said modules with a base, covering a junction between adjacent modules with a connector, and connecting said connector to said adjacent modules.

20. A method of assembling a crash barrier comprising supporting a module made in accordance with claim 6 on a base, and coupling said mounting portion to said base.

21. The method of claim 20 wherein said mounting portion comprises a guide member, and wherein said base comprises a support surface supporting a bottom of said module and a longitudinal track, wherein said guide member is received in said track.

22. The method of claim 21 wherein said track comprises a cavity and a slot opening upwardly from said cavity, and said guide member comprises a leg portion extending through said slot and a foot portion received in said cavity, wherein said foot portion is shaped so as to not be removable through said slot.

* * * * *